US009225082B2

(12) United States Patent
Frank

(10) Patent No.: US 9,225,082 B2
(45) Date of Patent: Dec. 29, 2015

(54) DEVICE FOR ELECTRICALLY CONNECTING A CABLE, IN PARTICULAR A PLUG-IN CONNECTOR PART

(75) Inventor: Erich Frank, Hochdorf (DE)

(73) Assignee: PFISTERER KONTAKTSYSTEME GMBH, Winterbach (DE)

( * ) Notice: Subject to any disclaimer, the term of this patent is extended or adjusted under 35 U.S.C. 154(b) by 0 days.

(21) Appl. No.: 13/261,449

(22) PCT Filed: Apr. 13, 2011

(86) PCT No.: PCT/EP2011/001841

§ 371 (c)(1),
(2), (4) Date: Oct. 2, 2012

(87) PCT Pub. No.: WO2011/128078

PCT Pub. Date: Oct. 20, 2011

(65) Prior Publication Data

US 2013/0029539 A1 Jan. 31, 2013

(30) Foreign Application Priority Data

Apr. 14, 2010 (DE) ..... 10 2010 014 981

(51) Int. Cl.
*H01R 9/05* (2006.01)
*H01R 4/18* (2006.01)
*H01R 101/00* (2006.01)

(52) U.S. Cl.
CPC ..... *H01R 9/05* (2013.01); *H01R 4/183* (2013.01); *H01R 2101/00* (2013.01)

(58) Field of Classification Search
CPC ..... H01R 9/05
USPC ..... 439/578–585
See application file for complete search history.

(56) References Cited

U.S. PATENT DOCUMENTS

| | | | | |
|---|---|---|---|---|
| 3,649,946 | A | 3/1972 | Frowein | |
| 7,040,909 | B2 * | 5/2006 | Cairns | G02B 6/3816 439/271 |
| 7,195,514 | B2 * | 3/2007 | Wakefield | H01R 13/5804 439/465 |
| 7,249,969 | B2 * | 7/2007 | Paynter | H01R 9/0524 439/578 |
| 7,540,772 | B2 * | 6/2009 | Sardi | B60L 11/1818 439/581 |
| 7,731,529 | B1 * | 6/2010 | Islam | H01R 9/0521 439/583 |
| 7,914,326 | B2 * | 3/2011 | Sutter | H01R 9/0521 439/578 |
| 7,934,954 | B1 * | 5/2011 | Chawgo | H01R 9/0524 439/578 |
| 7,993,159 | B2 * | 8/2011 | Chawgo | H01R 9/0524 439/584 |
| 8,038,472 | B2 * | 10/2011 | Montena | H01R 9/0524 439/578 |
| 8,047,870 | B2 * | 11/2011 | Clausen | H01R 9/0524 439/578 |
| 8,113,878 | B2 * | 2/2012 | Clausen | H01R 24/564 439/584 |
| 8,323,056 | B2 * | 12/2012 | Clausen | H01R 24/564 439/584 |

(Continued)

FOREIGN PATENT DOCUMENTS

| | | |
|---|---|---|
| DE | 1 160-523 | 2/1964 |
| DE | 203 08 191 U1 | 7/2003 |

(Continued)

*Primary Examiner* — Ross Gushi
(74) *Attorney, Agent, or Firm* — Wenderoth, Lind & Ponack, L.L.P.

(57) ABSTRACT

A device (11) for electrically connecting a cable, in particular a plug-in connector part (2), has a housing (48) in which a connecting element (78) can be mechanically fixedly connected to an inner conductor (53) of the cable. The device (11) also includes at least one fixing element (81, 85, 87) for immovably fixing the connecting element (78) and the inner conductor (53) of the cable in the housing (48) by positive engagement when a tensile force occurs.

15 Claims, 14 Drawing Sheets

(56) References Cited

U.S. PATENT DOCUMENTS 8,333,612 B2 * 12/2012 Natoli ..... H01R 13/02 439/578
8,388,375 B2 * 3/2013 Chawgo ..... H01R 9/0524 439/578
2004/0142596 A1 * 7/2004 Henningsen ..... H01R 9/0521 439/584
2004/0198095 A1 * 10/2004 Laverick ..... H01R 9/0518 439/585
2004/0224552 A1 * 11/2004 Hagmann ..... H01R 4/5066 439/461
2006/0089041 A1 * 4/2006 Wakefield ..... H01R 13/5804 439/465
2007/0087621 A1 * 4/2007 Fukushima ..... H01R 9/0524 439/460
2008/0207051 A1 8/2008 Montena
2009/0181575 A1 * 7/2009 Hung ..... H01R 9/0521 439/583
2009/0197465 A1 * 8/2009 Montena ..... H01R 9/0527 439/584
2009/0233482 A1 * 9/2009 Chawgo ..... H01R 9/0524 439/578
2010/0087090 A1 * 4/2010 Islam ..... H01R 24/40 439/578
2010/0093211 A1 * 4/2010 Sutter ..... H01R 9/0521 439/578
2010/0130060 A1 * 5/2010 Islam ..... H01R 9/0521 439/584
2010/0151728 A1 * 6/2010 Chabalowski ..... H01R 9/0521 439/584
2010/0178799 A1 * 7/2010 Lee ..... H01R 4/4818 439/578
2010/0178800 A1 * 7/2010 Clausen ..... H01R 9/0524 439/578
2010/0216339 A1 * 8/2010 Burris ..... H01R 24/40 439/578
2010/0261379 A1 * 10/2010 Blakborn ..... H01R 13/41 439/578
2010/0261381 A1 * 10/2010 Montena ..... H01R 9/032 439/584
2010/0261382 A1 * 10/2010 Montena ..... H01R 24/564 439/584
2011/0021070 A1 * 1/2011 Burris ..... H01R 13/502 439/578
2011/0201230 A1 * 8/2011 Islam ..... H01R 13/565 439/578
2011/0201232 A1 * 8/2011 Islam ..... H01R 13/565 439/583
2011/0244722 A1 * 10/2011 Chawgo ..... H01R 9/0524 439/578
2011/0263154 A1 * 10/2011 Chawgo ..... H01R 9/0524 439/584
2011/0318958 A1 * 12/2011 Burris ..... H01R 24/40 439/578
2012/0064768 A1 * 3/2012 Islam ..... H01R 9/0521 439/585
2012/0088407 A1 * 4/2012 Natoli ..... H01R 24/564 439/585
2012/0149239 A1 * 6/2012 Clausen ..... H01R 24/564 439/584
2012/0171895 A1 * 7/2012 Burris ..... H01R 9/0521 439/584
2012/0270438 A1 * 10/2012 Natoli ..... H01R 13/02 439/578
2012/0270442 A1 * 10/2012 Holliday ..... H01R 9/0518 439/585
2013/0029522 A1 * 1/2013 Holliday ..... H01R 9/05 439/584
2013/0029539 A1 * 1/2013 Frank ..... H01R 4/183 439/750
2013/0035003 A1 * 2/2013 Frank ..... H01R 13/14 439/750
2013/0102185 A1 * 4/2013 Mulfinger ..... H01R 13/516 439/460
2013/0323968 A1 * 12/2013 Chawgo ..... H01R 9/0524 439/584

FOREIGN PATENT DOCUMENTS

DE 20 2009 005 366 U1 8/2009
WO WO 2005/027273 A1 3/2005

* cited by examiner

DEVICE FOR ELECTRICALLY CONNECTING A CABLE, IN PARTICULAR A PLUG-IN CONNECTOR PART

FIELD OF THE INVENTION

The invention relates to a device for electrically connecting a cable, in particular a plug-in connector part.

BACKGROUND OF THE INVENTION

In electrical plug-in connectors, a plug element and a socket element are mated, with the contact elements of the plug element and of the socket element coming into electrical contact with one another and the electrical current being carried via contact elements. To prevent a deterioration of the electrical contact properties when a tensile force arises on the cable, clamping the device to the jacket of the cable to accommodate the tensile forces is known.

SUMMARY OF THE INVENTION

An object of the invention is to provide a generic device which, compared to known devices, has improved performance characteristics; in particular, by ensuring a stable electrical connection with low contact resistance even when tensile forces or vibrations arise.

This object is basically achieved by the device for electrically connecting a cable, in particular a plug-in connector, having a housing with a connecting element mechanically tightly connectable to an inner conductor of the cable. The device furthermore has at least one fixing element by which the connecting element and thus the inner conductor of the cable is fixed immovably in the housing by positive engagement when a tensile force arises.

In one embodiment, the connecting element mechanically tightly connected is also connected in an electrically conductive manner to one core of the cable, preferably to the inner conductor of the cable.

Due to the positive engagement, applying the fixing forces by clamping, i.e., by static friction forces, is unnecessary. The fixing takes place independently of the friction forces owing to the shape of the element. Compared to the prior art, this structure yields the advantage that the creep properties that arise in the course of aging and/or temperature change need not be compensated. Furthermore, advantageously, clamping forces need not be applied to the cable jacket; they can lead to an unwanted change in the electrical properties. In one embodiment, at least one part of the fixing element is made of plastic.

In one embodiment, the connecting element is sleeve-shaped, at least in sections. The connecting element can be mechanically tightly connectable to the core of the cable by clamping, especially by pressing. The core of the cable can be made as a one-piece solid conductor, as a multipart solid conductor or as a flexible lead, and can carry the electrical current of the cable.

The connection between the connecting element and the core of the cable can take place directly, i.e., with direct contact between the connecting element and the core of the cable, or indirectly, for example, by interposing an electrical connecting element that in turn can also provide, preferably in one piece, the electrical contact element for electrically connecting the device to another plug-in connector part.

In one embodiment, the connecting element has a contact surface forming a positive engagement in the direction of the tensile force for the contact of the fixing element. The contact surface can be formed, for example, by a surface extending to the outside or inside in the radial direction, for example, by a widening of the connecting element. The widening is flange-shaped at least in sections. The flange-shaped widening can form a closed ring, or it can be provided only in sections in the peripheral direction.

In one embodiment, the fixing element has a contact surface forming a positive engagement in the direction of the tensile force for the contact of the fixing element with the housing. The fixing element can be made, for example, as a latch extending obliquely or especially transversely to the direction of the tensile force, being pluggable into an opening in the housing extending transversely to the tensile force, and thus directly facilitating a fixing of the connector element.

In one embodiment, the position of the positive contact of the fixing element in the direction of the tensile force and thus in the axial direction of the device is spaced apart from the position of the positive contact of the fixing element with the connecting element. For example, the positive contact of the fixing element with the connecting element can be near a contact element of the device, especially near the connection of the connecting element to the core of the cable. The positive contact of the fixing element with the housing is set back relative to it, especially at one end of the housing of the device remote from the contact element.

In one embodiment, the fixing element is in several parts. The parts are arranged in succession in the direction of the tensile force. The several parts are in positive contact with one another in the direction of the tensile force directly or indirectly with positive interposition of another element. For example, as another element, a connecting lead for a shield of the cable can be routed between two parts of the fixing element that are adjacent or located in succession in the direction of the tensile force. As a result, the cable shield can be routed radially to the outside and can be brought, for example, into electrical contact-making contact with a metallic housing part of the device. The parts of the fixing element can be made sleeve-shaped and can accommodate the cable in their interior. At least one part of the fixing element can be made as a latch that can be plugged in obliquely and especially transversely to the direction of the tensile force.

In one embodiment, the device has an elastically deformable spring element. With the spring element, the connecting element is preloaded within the housing in the direction to the positive contact with the fixing element. In this way, play-free mounting of the connecting element in the device is ensured. In one direction, the connecting element is locked by the positive contact with the fixing element, while in the opposite direction the connecting element can be moved against the resetting force of the spring element.

In one embodiment, the spring element is in contact with an intermediate element. The intermediate element is kept in contact with the connecting element by the reset force of the spring element. The intermediate element can be made of an electrically insulating material, thus ensuring electrical insulation of the connecting element relative to the housing.

In one embodiment, the intermediate element is sleeve-shaped at least in sections. The intermediate element can have a shoulder that projects radially to the outside, especially a flange-shaped widening. By the widening, the intermediate element is in contact with the spring element. The intermediate element can have a shoulder that projects radially to the inside, especially a ring-shaped shoulder. By the shoulder, the intermediate element is in contact with the connecting element.

The device can have a stop to ensure that the spring element is compressed only at a maximum of 30%. In this way, a mechanical overload for the spring element is prevented.

In one embodiment, the intermediate element forms a shock protection for an electrical contact element of the device. For this purpose, the intermediate element in the plug-in direction of the device can project in the form of a sleeve over the contact element. Alternatively or in addition, the intermediate element can also extend in the opposite direction longer than the connector element.

In one embodiment, the device is designed for electrical voltages in the range of more than 12 V and less than 2400 V, especially more than 24 V and less than 1000 V and preferably up to an operating voltage of 700 V. In one embodiment, the device is used in automotive engineering, especially for electric or hybrid vehicles, or for electrical prime movers.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
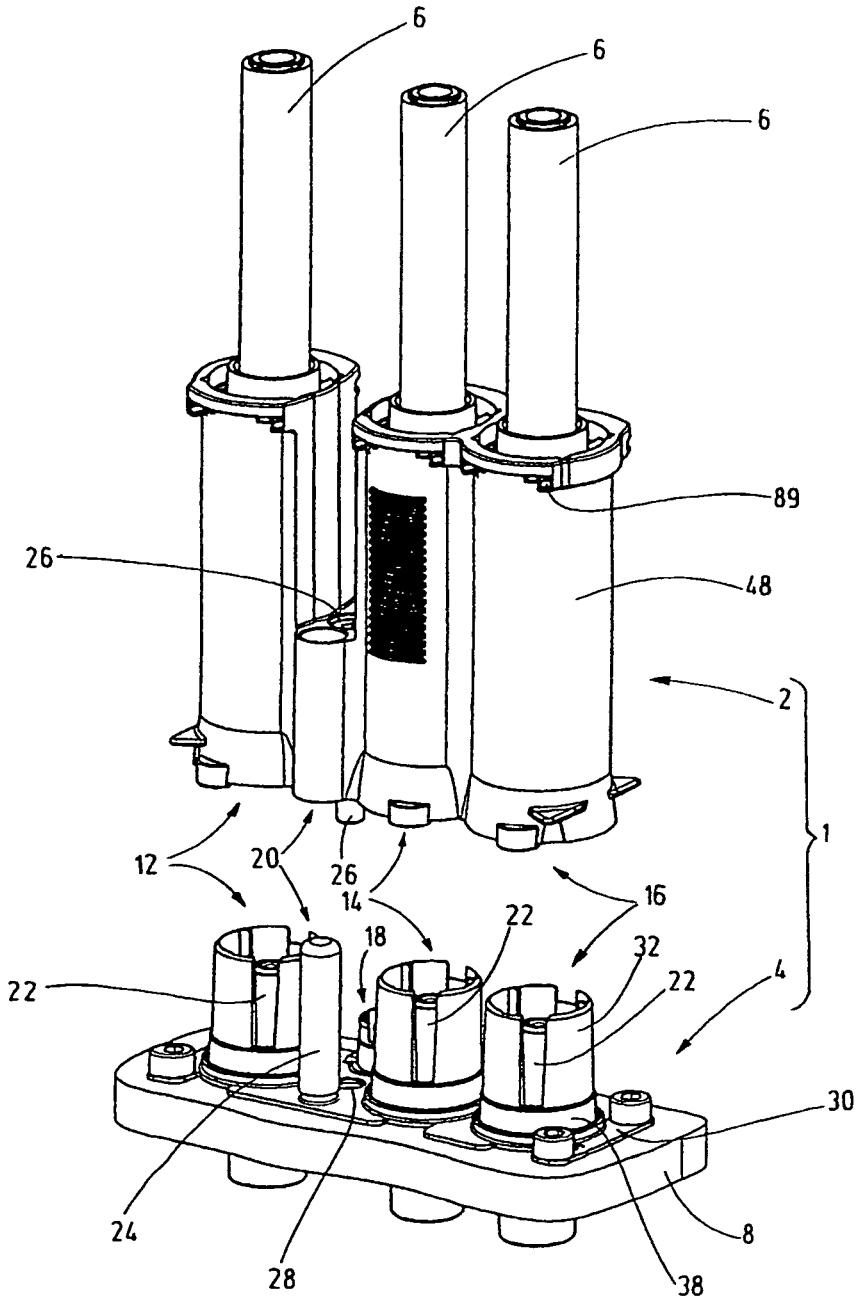
FIG. 1 is a perspective view of a plug-in connector system according to a first exemplary embodiment of the invention.

FIG. 1 shows a perspective view of a first exemplary embodiment of a plug-in connector system 1 having a first plug-in connector part 2 and a second plug-in connector part 4 in the as-yet unmated state. The first plug-in connector part 2 is designed as a three-pole plug with which three single-pole electrical lines 6, each made as a cable with a cable jacket, can be electrically connected to the second plug-in connector part 4. A housing 48 contains, for example, the sleeve-shaped contact elements shown in FIGS. 17 and 18 and brought into electrical contact with preferably cylindrical contact pins 22 in the second plug-in connector part 4 when the first and second plug-in connector parts 2, 4 are mated.

The second plug-in connector part 4 in the exemplary embodiment is located on a housing wall 8 of a generating set, for example, on a generator or on an electric motor. The first and second plug-in connector parts 2, 4 each have three load contacts 12, 14, 16 used for electrically connecting the electrical lines 6, and one pilot contact 18. In FIG. 1, only the pertinent pilot contact of the second plug-in connector part 4 is partially visible.

The two plug-in connector parts 2, 4 moreover have components 20 for guiding the first plug-in connector part 2 when mated with the second plug-in connector part 4. On the sides of the second plug-in connector part 4, pin 24 serves as a guide component, is cylindrical at least in sections and is tapered on its end facing the first plug-in connector part 2 that is especially rounded and/or has a conical surface.

Between the components 20 for guidance and the pilot contact 18, the two plug-in connector parts 2, 4 have components for interlocking the first plug-in connector part 2 on the second plug-in connector part 4. In the exemplary embodiment, the side of the first plug-in connector part 2 has a connecting screw 26. Sides of the second plug-in connector part 4 have a threaded hole 28. The second plug-in connector part 4 is preferably detachably mounted by means of a terminal strip 30 on the housing wall 8. In the exemplary embodiment strip 30 is screwed on.

Figure 2:
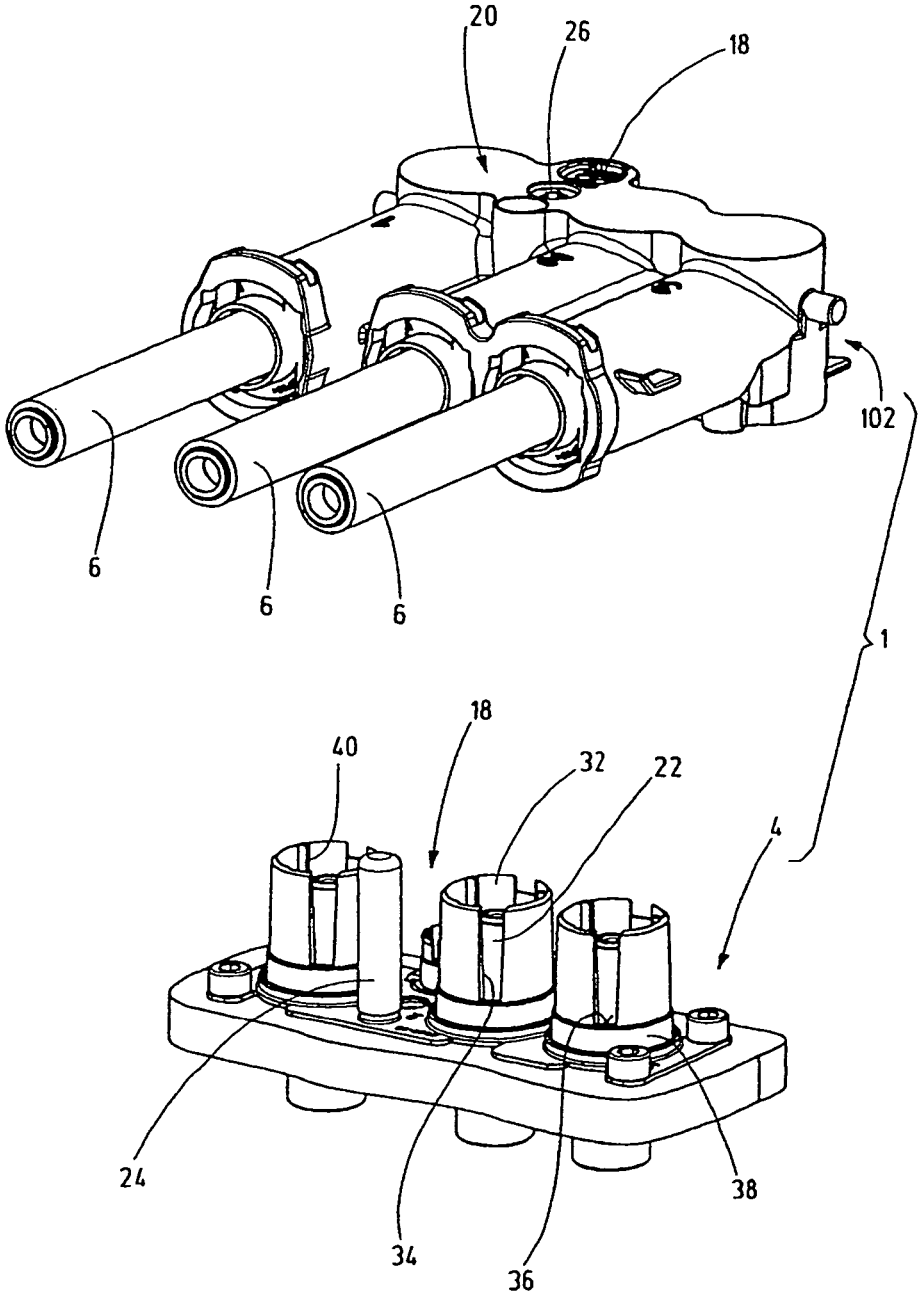
FIG. 2 is a perspective view of a plug-in connector system according to a second exemplary embodiment of the invention.

In the first exemplary embodiment of FIG. 1, the first plug-in connector part 2 has a line guide extending parallel to the plug-in direction. FIG. 2 shows a second exemplary embodiment of a plug-in connector system 1 in which the first plug-in connector part 102 has a line guide of the electrical lines 6 extending angled to the plug-in direction, especially a line guide angled by 90°. The second plug-in connector part 4 is made identically to the second plug-in connector part 4 of the first exemplary embodiment of FIG. 1. In particular, a first plug-in connector part 2 with a line guide extends parallel to the plug-in direction, as shown in FIG. 1. A first plug-in connector part 102 with a line guide extending angled to the plug-in direction can be mated to the same second plug-in connector part 4.

Figure 3:
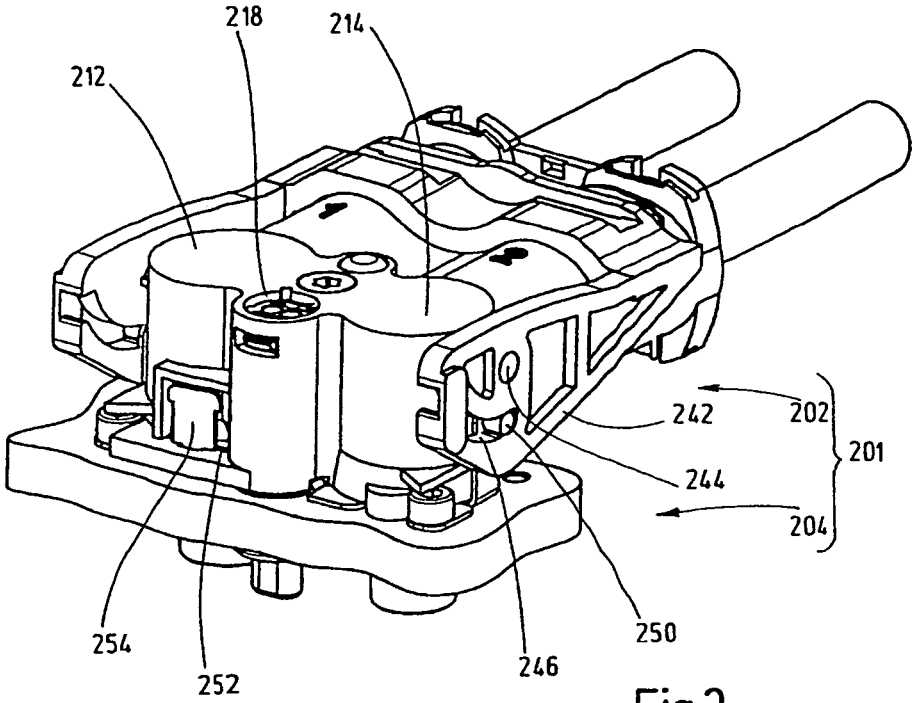
FIG. 3 is a perspective view of a plug-in connector system according to a third exemplary embodiment of the invention.

The components of a first component group with components for the pilot contact 18 and the components for the three load contacts 12, 14, 16 are always independent of a pole number of the first plug-in connector part 102 that is determined by the number of load contacts 12, 14, 16. In particular, the pilot contact 18 is always made identically, regardless of whether it is a one-pole, two-pole, or n-pole plug-in connection. This independence is likewise true of the load contacts 12, 14, 16 in the straight version and the load contacts 212, 214 in the angled version (FIG. 3). The components 20 for guidance during mating and the components 26 for the fixing of the first plug-in connector part 2 on the second plug-in connector part 4 are made independently of the number of poles.

The housing 48 of the first plug-in connector part 2 has a number of receiving chambers for the components of the load contacts 12, 14, 16, which number corresponds to the pole number determined by the number of load contacts 12, 14, 16. The components of the load contacts 12, 14, 16 located within the housing 48 are made identically. The components 20 for guidance during mating and the components of the pilot contact 18 and of the fixing 26 are located between the first load contact 12 located on the left in FIGS. 1 and 2 and the middle load contact 14. In one embodiment, this arrangement is also retained for two-pole or multipole plug-in connections. In particular, the arrangement of the components 20 for guidance of the pilot contact 18 and of the connector 26 is always located between two adjacent load contacts 12, 14, regardless of the number of poles of the plug-in connector system 1.

The second plug-in connector part 4 has a sleeve-shaped portion 32 projecting over the contact pin 22 in the axial direction. Portion 32 can be used for further guidance of the first plug-in connector part 2, 102 when mated to the second plug-in connector part 4. The sleeve-shaped portion 32 has an opening 34 extending in the plug-in direction, being open in the direction of the first plug-in connector part 2, 102 and, in the exemplary embodiment, being formed by a slot. In the mated state, the first plug-in connector part 2, 102 with its housing 48 projects beyond one end 36 of the opening 34, which end faces the second plug-in connector part 4. This is followed by a ring-shaped and preferably cylindrical or conical portion 38 with which in the mated state a seal can be brought into contact and thus seals the contact elements of the plug-in connector system 1. On its inside, the sleeve-shaped portion 32 preferably has a guide 40 made in one piece, extending in the axial direction in the exemplary embodiment and made as crosspieces. By the guide 40 further guidance and/or reverse voltage protection is ensured during mating. In one embodiment, the guide and crosspieces as well as the pertinent recesses can form customer-specific coding of the plug-in connector system 1.

FIG. 3 shows a perspective view of a third exemplary embodiment of a plug-in connector system 201 with a two-pole first plug-in connector part 202 and a two-pole second plug-in connector part 204. The first plug-in connector part 202 is a right angle plug, with the line guide extending at a right angle to the plug-in direction.

Figure 4:
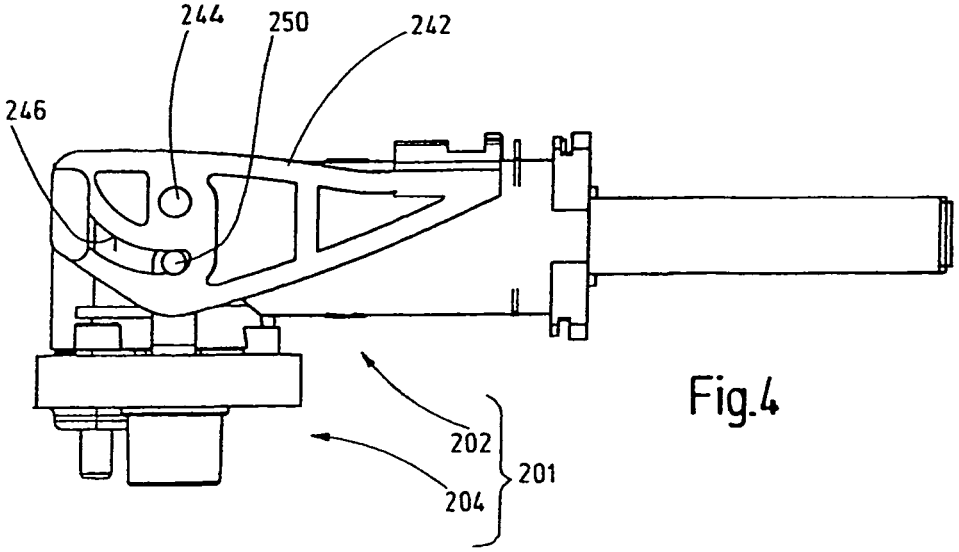
FIG. 4 is a side elevational view of the plug-in connector system of FIG. 3.
Figure 5:
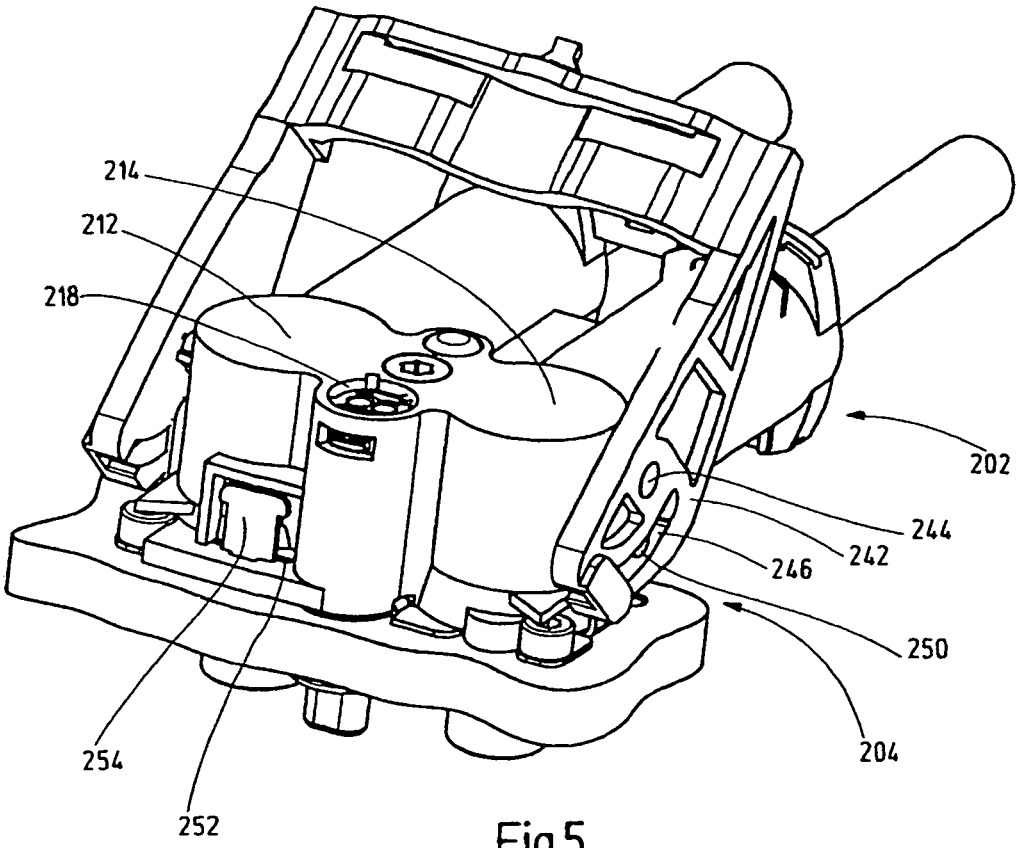
FIG. 5 is a perspective view of the plug-in connector system of FIG. 3 in a partially separated state.

FIG. 4 shows a side view of the plug-in connector system 201 of FIG. 3. FIG. 5 shows a perspective view of the plug-in connector system 201 in a partially separated state in a view which has been enlarged relative to FIGS. 3 and 4.

The first plug-in connector part 202 has a U-shaped actuating element 242 with which the two plug-in connector parts 202, 204 can be transferred out of the completely mated state in FIGS. 3 and 4 into a state shown in FIG. 5 in which the pilot contact 218 is either already separated, or, at least, is separated with a complete transfer of the actuating element 242 into a position having been turned or rotated by 90° relative to FIGS. 3 and 4. In this position the load contacts 212, 214 are still electrically connected. The actuating element 242 can be pivoted around an axle journal 244 formed preferably integrally from the first plug-in connector part 202. A radial cam 246 is made in the actuating element 242, for example, by a groove. A guide journal 250 located on the second plug-in connector part 204 is moved along the groove such that the first plug-in connector part 202 rises off the second plug-in connector part 204.

When the actuating element 242 assumes a position rotated by 90° relative to the position in FIG. 3, the pilot contact 218 of the first plug-in connector element 202 is no longer electrically connected to the pilot contact of the second plug-in connector element 204. The load contacts 212, 214 of the first plug-in connector element 202 are still electrically connected to the load contacts of the second plug-in connector element 204.

The actuating element 242 can be detachably locked in its first end position shown in FIGS. 3 and 4 and/or in a second end position rotated by 90°. Due to the lever action of the actuating element 242, both when breaking and when making the connection between the first and the second plug-in connector part 202, 204, only a small actuating force is necessary. This small activating force is especially advantageous at high temperatures and/or under dirty ambient conditions.

The first plug-in connector part 202 and the second plug-in connector part 204 have latches or latching elements 252, 254 corresponding to one another, in the exemplary embodiment. The latch 252 of the first plug-in connector part 202 is formed by a recess in one housing wall and is engaged by the latch 254 of the second plug-in connector part 204 as it is being fitted on and in doing so locks to the opening. For this purpose, the latch 254 of the second plug-in connector part 204 has a starting bevel by which the latch 254 is deflected during mating and snaps back as soon as the latching means 254 engages the opening in the first plug-in connector part 202.

After the first plug-in connector part 202 is transferred out of the position shown in FIGS. 3 and 4 into the position shown in FIG. 5 or beyond into a position in which the actuating element 242 has been pivoted by 90°, the latch 254 of the second plug-in connector part 204 is in contact with the edge of the opening of the first plug-in connector part 202, which opening forms the latch 252. This contact prevents complete withdrawal of the first plug-in connector part 202. Only after the latch 254 is disengaged from the latch 252, for example, by a screwdriver or other suitable tool which can be inserted, for example, into the opening and can be subsequently turned, can the first plug-in connector part 202 be completely removed.

In practical applications, there is a time delay of, for example, at least 0.5 to 1 second, because the actuating element 242 must be actuated first. The pilot contact 218 is separated, while the load contacts 212, 214 are still connected. Then, the latches 252, 254 must be disengaged, for example, by a tool, or alternatively also manually without a tool, before the first plug-in connector part 202 can be completely withdrawn. This procedure enables coordinating control of switching of the load contacts 212, 214 at no load, since separation of the pilot contact 218 signals that the connection is to be broken.

In mating, a connection of the load contacts 212, 214 may be established first by clipping on the first plug-in connector part 202. The pilot contact 218 is closed only by the subsequent pivoting of the actuating element 242, whereupon a coordinating control line can energize the load lines. Thus, both the insertion and the breaking of the electrical connection of the load contacts 212, 214 can take place at no load, as a result of which the electrical contacts are protected and a stable, reliable electrical connection can be made available.

Figure 6:
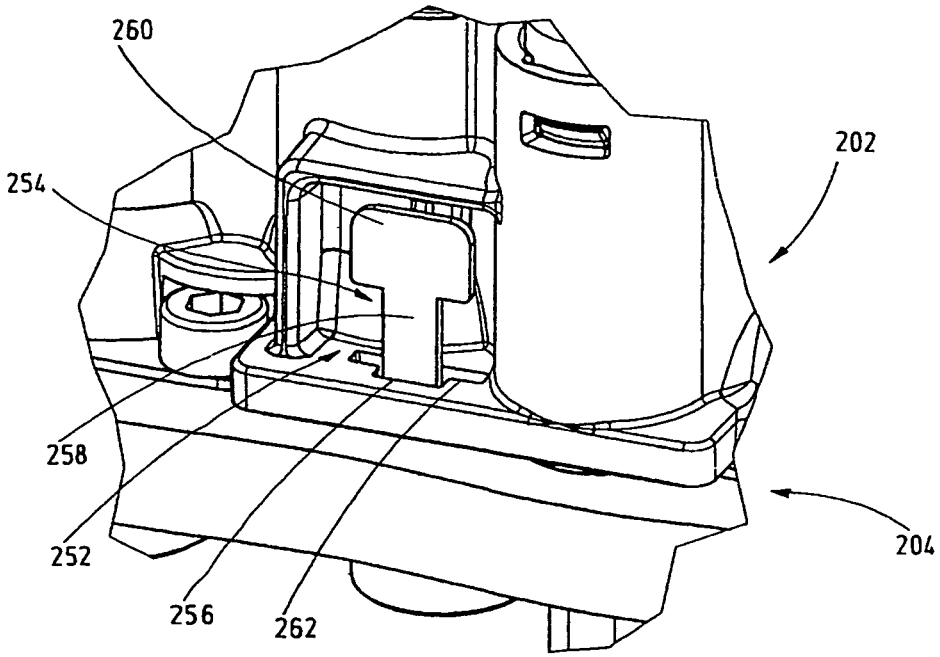
FIG. 6 is a partial perspective view of an enlarged extract in the region of the latch of the plug-in connector system of FIG. 3.
Figure 7:
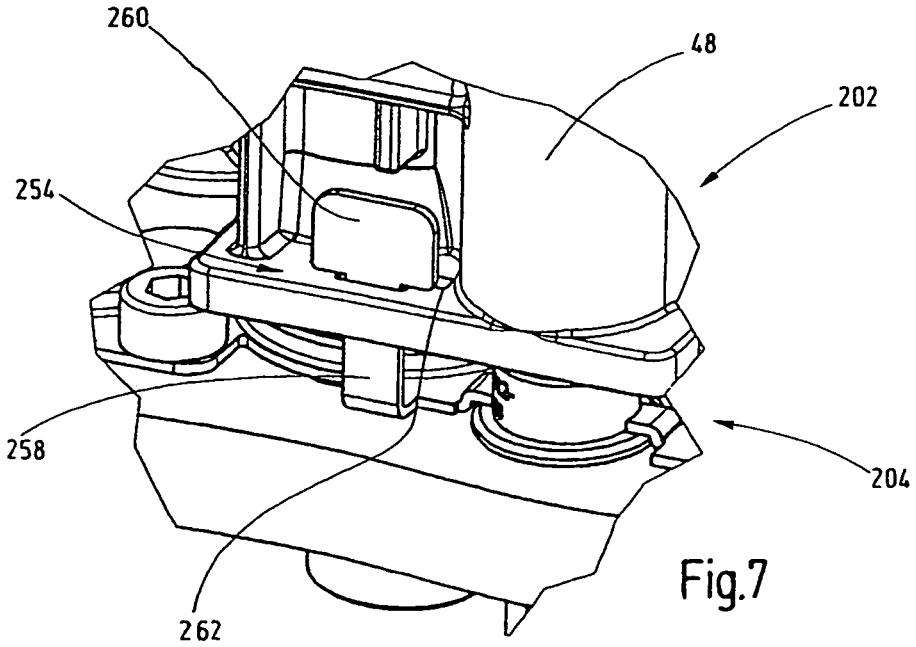
FIG. 7 is an enlarged, partial perspective view of the region of the latching elements of the plug-in connector system of FIG. 3.

FIG. 6 shows in a perspective view an enlarged extract in the region of the latches 252, 254 in a state in which the first plug-in connector part 202 is completely mated to the second plug-in connector part 204 and both the load contacts 212, 214, and the pilot contact 218 are closed. FIG. 7 shows an enlarged extract in the region of the latching elements 252, 254 in a state in which the first plug-in connector part 202 has been detached from the second plug-in connector part 204 to such an extent that the pilot contact 218 is separated, but the load contacts 212, 214 are still connected.

The latching element 252 of the first plug-in connector part has a first opening portion 256 which is slightly larger than a first portion 258 of the second latching element 254, but smaller than a second portion 260 of the second latching element 254. In this way, in the position shown in FIG. 7, the second portion 260 comes into contact with the housing 48 of the first plug-in connector part 2 and stops a complete withdrawal of the first plug-in connector part 202 from the second plug-in connector part 204. Only by deflecting the second latching element 254, for example, by a tool, is the second portion 260 superimposed on a second opening portion 262 of the first latching element 254, which second portion is larger than the first opening portion and is slightly larger than the second portion 260 of the second latching element 254, so that the first plug-in connector part 202 can be removed from the second plug-in connector part 204.

Figure 8:
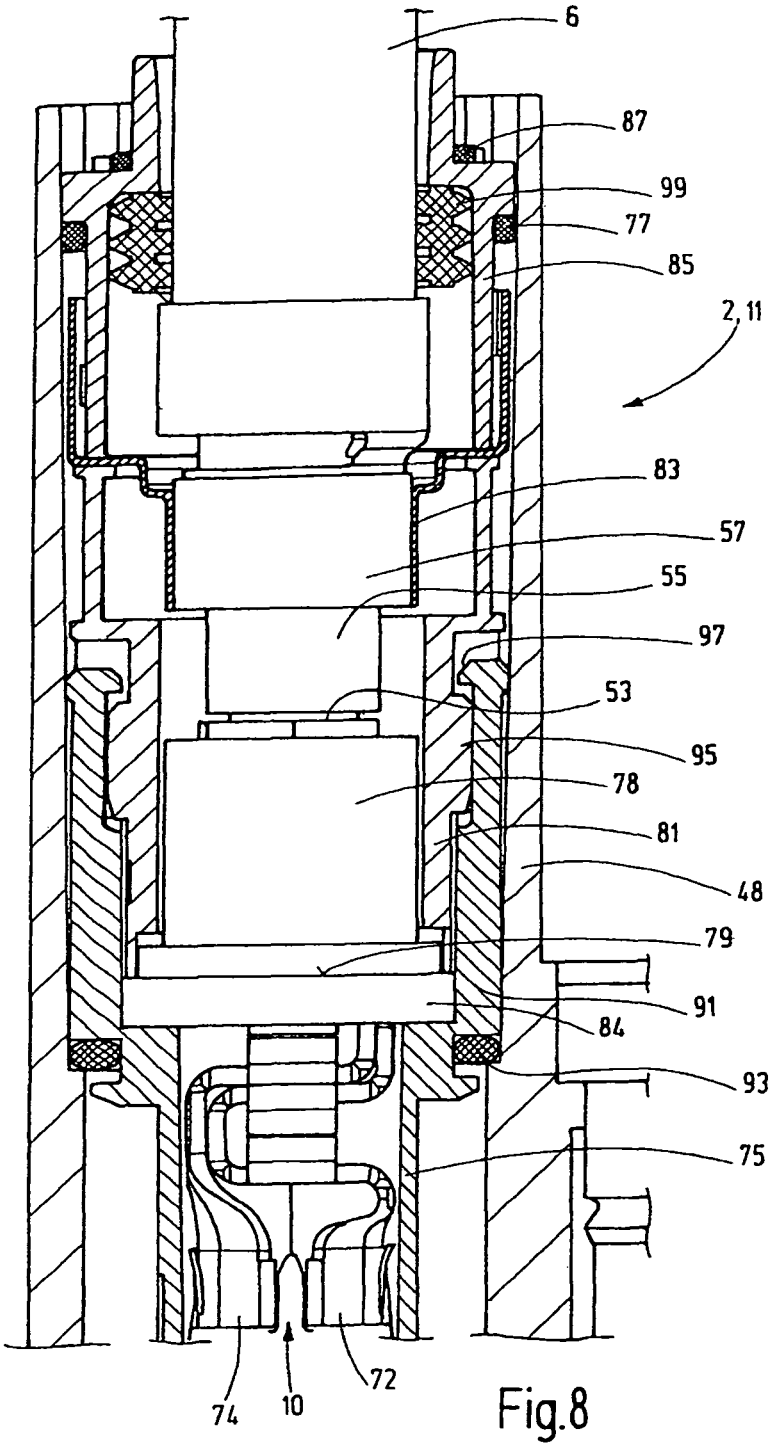
FIG. 8 is a partial front elevational view in section through the housing of the first plug-in connector part of the plug-in connector system of FIG. 1.
Figure 17:
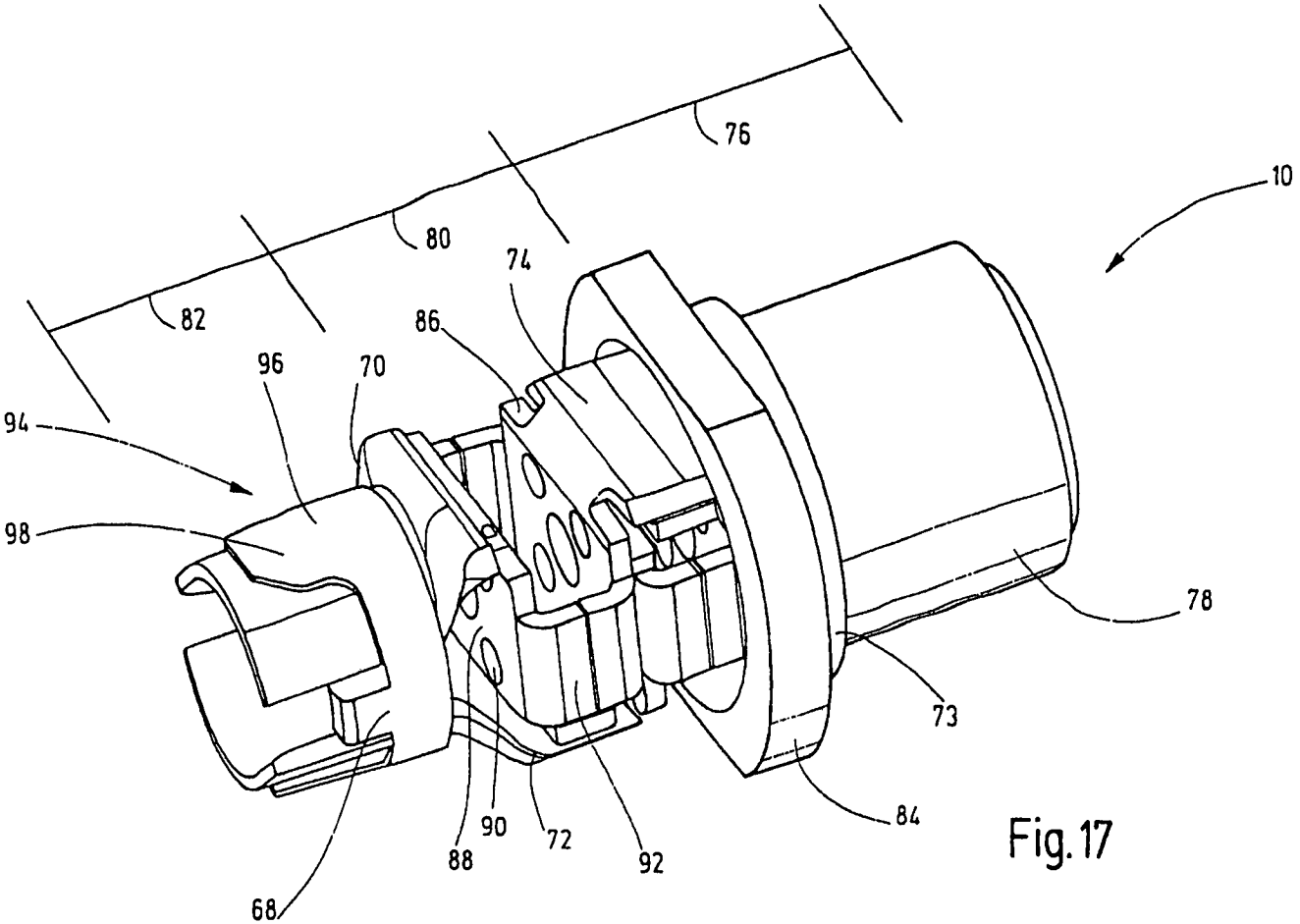
FIG. 17 is a perspective view of a first exemplary embodiment of a plug-in connector element for the plug-in connector system of FIG. 1.
Figure 18:
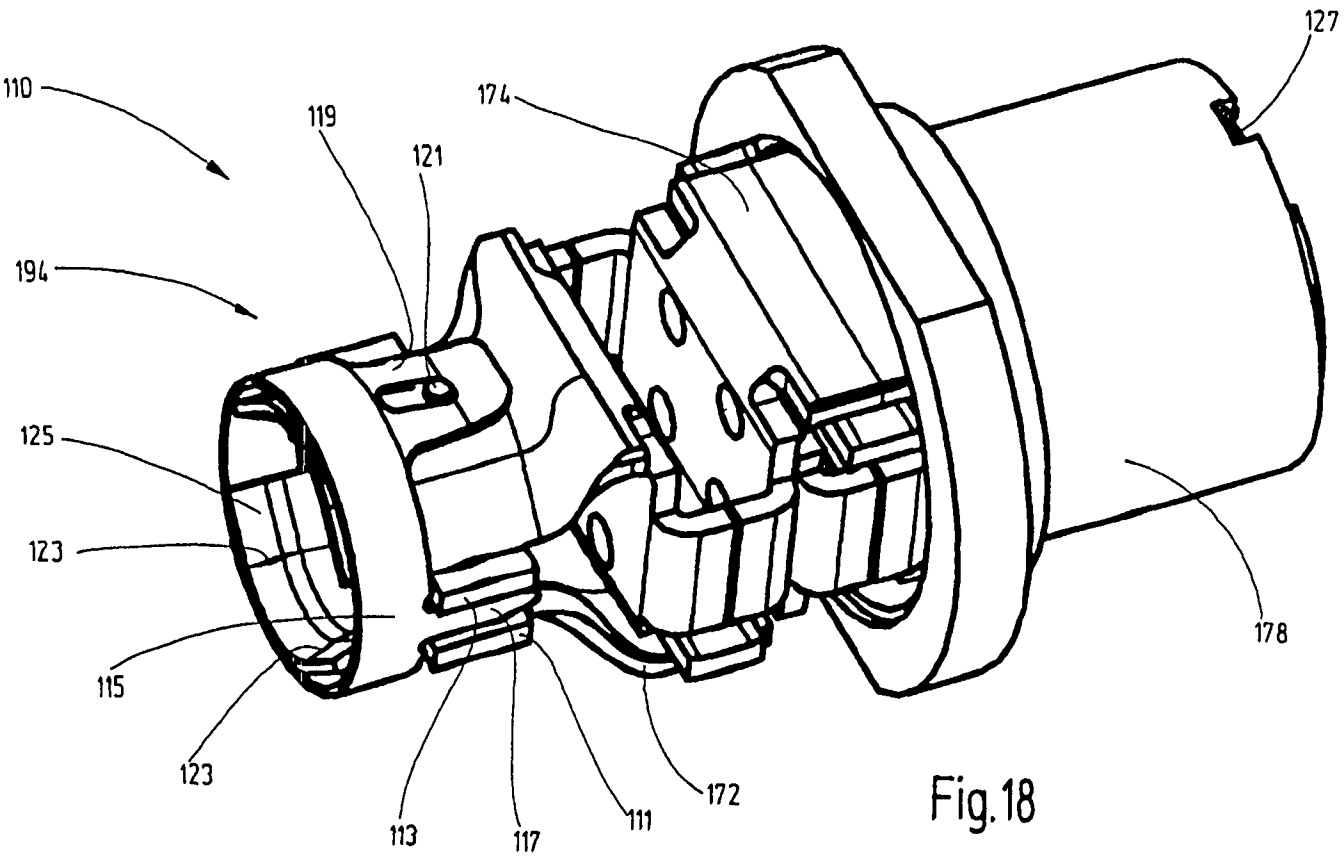
FIG. 18 is a perspective view of a second exemplary embodiment of a plug-in connector element for the plug-in connector system of FIG. 1.

FIG. 8 shows an extract of a section through the housing 48 of the first plug-in connector part 2 in a region in which the electrical line 6 shown in a front view is connected to the first plug-in connector part 2. The line 6 is a cable with an inner conductor 53 surrounded by insulation 55 onto which a metallically conductive cable shield 57 is applied outside. On its end, hidden by a sleeve-shaped connecting element 78, the inner conductor 53 is electrically and mechanically connected to an electrical plug-in connector element 10 described below (FIGS. 17, 18).

The plug-in connector part 2, which is a device 11 for electrically connecting the cable shield 57 of the electric line 6 to the housing 48, has a fixing element 81, 85, 87 with three parts in this exemplary embodiment. By these three parts, the connecting element 78, and thus, the inner conductor 53 are immovably fixed in the housing 48 by positive engagement when a tensile force arises on the line 6. The connecting element 78 is sleeve-shaped at least in sections and is mechanically tightly connected to the inner conductor 53, especially pressed to the inner conductor 53. Pressing takes place with interposition of two contact plates 72, 74 which also integrally form the contact element of the plug-in connector element 10.

The connecting element 78 on at least one end has a flange-shaped widening 84 forming a contact surface 79 for a first part 81 of the fixing element, which surface is preferably circularly ring-shaped and forms a positive engagement in the direction of the tensile force. The first part 81 of the fixing element is sleeve-shaped, surrounds the connecting element 78, and extends in the direction to an end oriented away from the contact element of the plug-in connector element 10 beyond the connecting element 78. On its face-side end, the first part 81 of the fixing element is in contact with a second part 85 of the fixing element which is likewise made sleeve-shaped and accommodates the line 6 in itself, with the interposition of a connecting lead 83 extending radially to the outside for the cable shield 57. On its end opposite the first part 81, the second part 85 has a contact surface for a third part 87 of the fixing element which in the direction of the tensile force forms a positive engagement with the housing 48.

The third part 87 of the fixing element in the exemplary embodiment is made clip-shaped, with the pertinent clips being insertable into an opening 89 (FIG. 1) intended for this purpose in the housing 48 in a direction obliquely and especially transversely to the plug-in direction or to the longitudinal direction of the line 6 to lock the fixing element in the housing 48. When a tensile force arises on the cable 6, this tensile force is transferred via the inner conductor 53 to the connecting element 78 in positive contact with the first part 81 of the fixing element; the first part 81 in turn is in positive contact with the second part 85; and the second part 85 is in turn is in positive contact with the third part 87. The third part 87 is in positive contact with the housing 48. In this way, a tight connection between the line 6 and the housing 48 is made available based solely on positive contact and independent of friction forces.

The device 11 is a component of a receiving chamber assigned to each pole for one load contact 12, 14, 16, 212, 214 at a time in each embodiment of the housing 48 of the first plug-in connector part 2. The device 11 can be made identically both for straight plug-in connectors and for right angle plug-in connectors, except for the execution of the contact elements.

The device 11 has an intermediate element 91 which can be made of a plastic. The intermediate element 91 can also be referred to as an insulating sleeve. The intermediate element 91 encompasses the connecting element 78 at least in sections and projects beyond the connecting element 78 in the direction to the contact element of the plug-in connector element 10. In the illustrated exemplary embodiment, the intermediate element 91 integrally forms a sleeve-shaped guide portion 75 which, when the first and second plug-in connector parts 2, 4 are mated, comes into contact with the sleeve-shaped portion 32 (FIG. 1) of the second plug-in connector part 4 and is guided.

The device 11 has a spring element 93 with which the connecting element 78 in the housing 48 is preloaded in the direction to the positive engagement with the fixing element; in the exemplary embodiment, connecting element 78 is preloaded in the direction to the first part 81 of the fixing element. The spring element 93 is, on the one hand, in contact with a shoulder of the intermediate element 91, which shoulder projects radially to the outside; and, on the other hand, is in contact with a shoulder of the housing 48 which projects radially to the inside. A stop ensures that the spring element 93 can be pressurized only up to a definable value, for example, up to 30% compression.

In a portion between the positive contact with the connecting element 78 and the positive contact with the second part 85 and the connecting lead 83 for a cable shield 57, the first part 81 of the fixing element has a latch 95 with which the first part 81 can be locked to the intermediate element 91 when the device 11 is being mounted. In the exemplary embodiment, the latch 95 is formed by a portion of larger radial dimension which can engage a correspondingly shaped recess in the intermediate element 91 by latching. On its end oriented away from the contact element of the plug-in connector element 10, the intermediate element 91 can have a slotted portion, and on the end thereof a starting bevel 97 can be provided for locking in of the first part 81.

On its end oriented away from the contact element of the plug-in connector 10, the second part 85 of the fixing element projects beyond the end of the housing 48, as a result of which the electric line 6 is guided. On the inside near this axial end between the second part 85 and the line 6, a sealing element 99 in the axial direction forms several sealing surfaces. In the exemplary embodiment sealing element 99 has the cross-sectional shape of a corrugated tube. The sealing element 99 also ensures guidance of the line 6 in the housing 48. In the region of the sealing element 99, radially to the outside, the third part 87 of the fixing element is in contact with the inner surface of the housing 48 by another sealing element 77. The third part 87 can also be referred to as an interlock.

Figure 9:
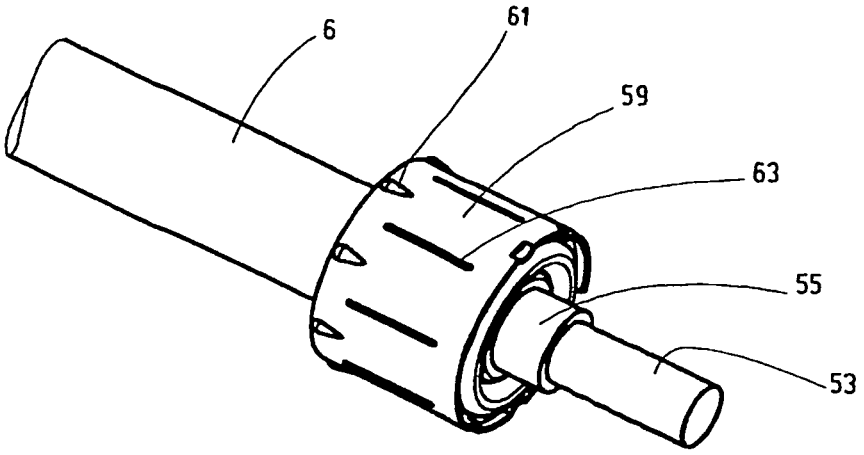
FIG. 9 is a perspective view of one section of the line with the insulation stripped on the conductor end of the plug-in connector system of FIG. 1.

FIG. 9 shows a perspective view of a portion of the line 6 with the insulation 55 stripped from the conductor end to expose the inner conductor 53. In the region of the insulation 55, a substantially ring-shaped shielding element 59 makes electrical contact with the cable shield 57 (FIG. 8). The shielding element 59 can be formed from a flat sheet metal part produced by punching. In the formed state, shielding element 59 has a ring-shaped portion that can be brought into contact with the line 6 to be connected. Moreover, the shielding element 59 in the peripheral direction has radially projecting contact tongues 61, preferably uniformly distributed. Tongues 61 can be brought into contact with the housing 48 and, in this way, make electrical contact with the housing 48. The shielding element 59 has slots 63 extending in the direction of the inner conductor 53, preferably uniformly distributed in the peripheral direction and reducing the eddy currents occurring in the shielding element 59.

Figure 10:
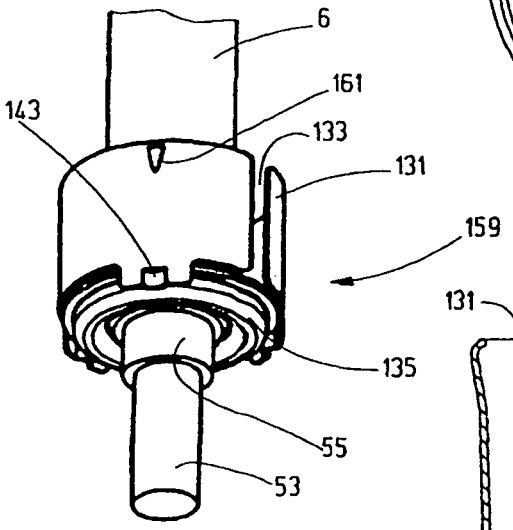
FIG. 10 is a perspective view of one section of the line with an alternative embodiment of a shielding element.
Figure 11:
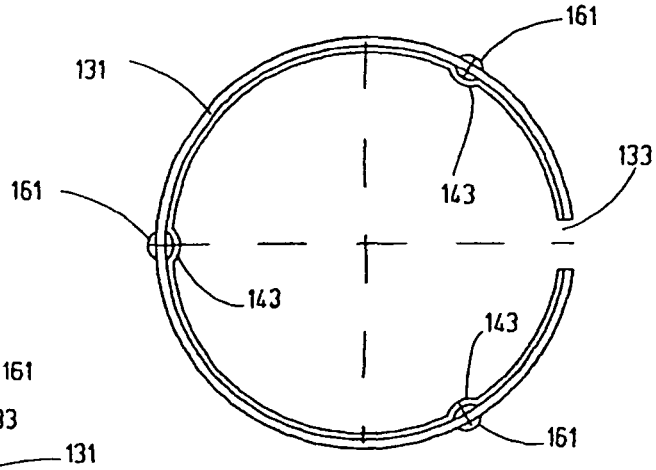
FIG. 11 is a top plan view of the first part of the shielding element of FIG. 10.
Figure 12:
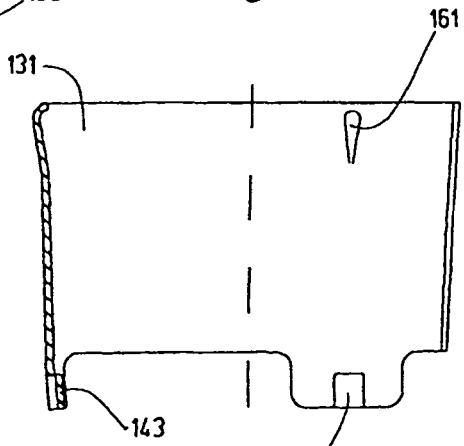
FIG. 12 is a side elevational view in section of the first part of the shielding element of FIG. 10.
Figure 13:
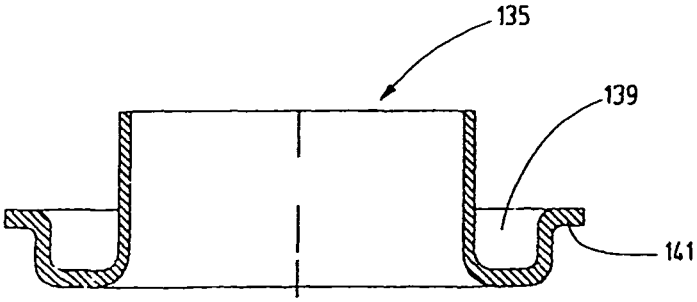
FIG. 13 is a side elevational view in section through a second part of the shielding element of FIG. 10.

FIG. 10 shows a perspective view of one portion of the line 6 with an alternative embodiment of a shielding element 159 made in several parts. A first part 131 of the shielding element 159 can be made as a punched/bent part and can have a continuous axial slot 133 by which the first part 131 can be elastically deformed. The first part 131 can also be referred to as a shielding contact. FIG. 11 shows a top view of the first part 131. FIG. 12 shows a side view of a section through the first part 131. The first part 131 forms a contact element for the cable shield 57 of the line 6. FIG. 13 shows a section through a second part 135 of the shielding element 159 with which the cable shield 57 can make electrical contact and in particular can establish an electrically conductive connection between the cable shield 57 and the first part 131. The second part 135 can also be referred to as a shield crimp.

Figure 14:
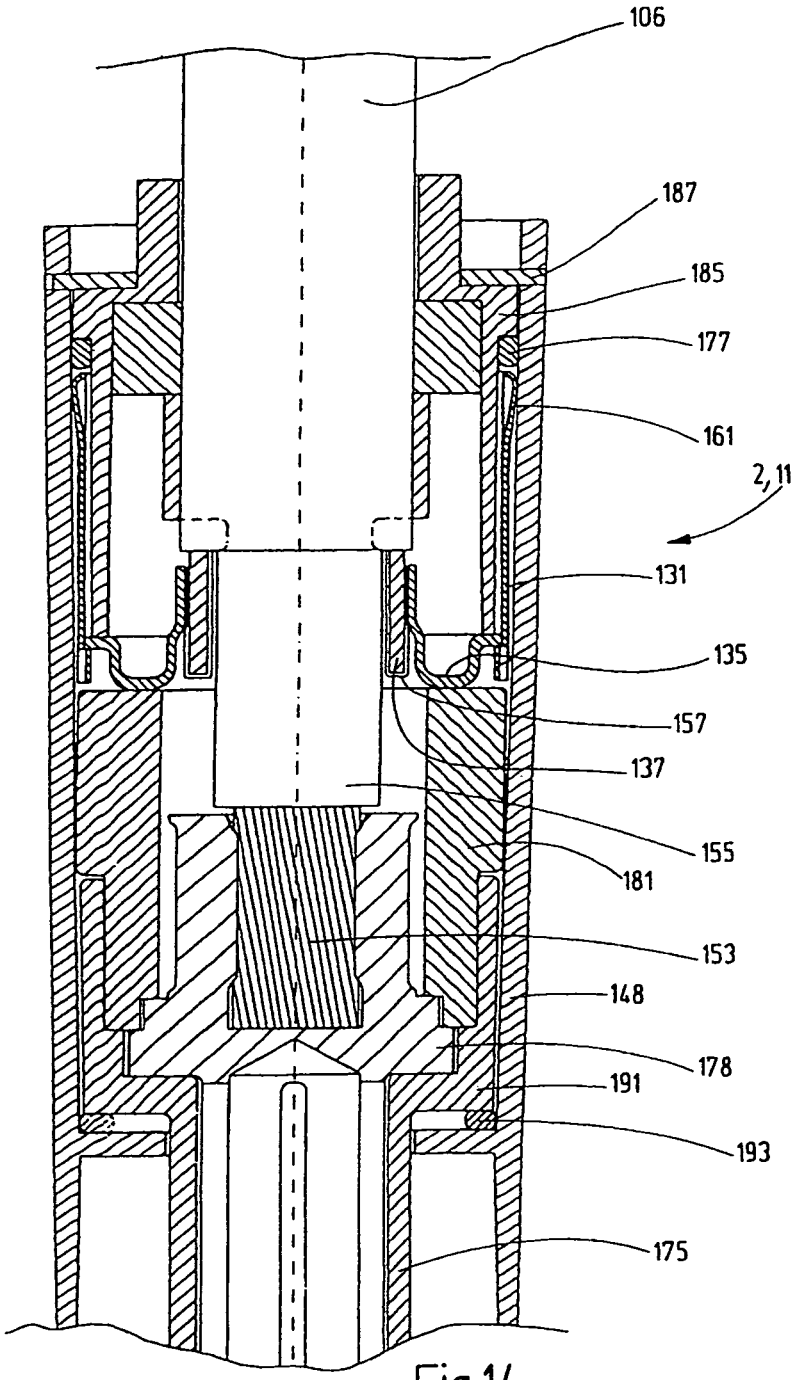
FIG. 14 is a partial side elevational view in section through a second exemplary embodiment of a housing of the first plug-in connector part.

FIG. 14 shows an extract of a section through a second exemplary embodiment of a housing 148 of the first plug-in connector part 2. To the extent that corresponding features are designated the same way as in the exemplary embodiment of FIG. 8, reference numbers are used increased by 100 relative to the reference numbers used in FIG. 8. In the exemplary embodiment of FIG. 14, a shielding element 159 is used as is shown in FIGS. 10 to 13. The shielding element 159 encompasses a third part 137 with which the cable shield 157 of the line 106 is mechanically fixed, especially crimped. The third part 137 can also be referred to as a support crimp. The third part 137 tightly surrounds both the cable shield 157 on the insulation 155 and also the outer cable jacket of the line 106. The portion of the third part 137 surrounding the insulation 155 and the cable shield 157 is spaced axially apart from the portion of the third part 137 surrounding the outer cable jacket. The exemplary embodiment of the housing 148 of FIG. 14, like the exemplary embodiment of FIG. 8, is cone-shaped inside. In contrast to FIG. 8, in the housing 148 of FIG. 14, the outside shape is also conical since the wall thickness is roughly the same.

The projecting end of the cable shield 157, which has been shortened to a suitable length, is turned up over the portion surrounding the insulation 155 and the cable shield 157 and is surrounded by the second part 135 of the shielding element 159. The second part 135 is shaped such that its outer edge extends almost to the inner surface of the housing 148. To stiffen the face-side end of the second part 135, the end has a stiffener 139 which in the exemplary embodiment is formed by a ring-shaped depression. On the outside, the second part 135 has a preferably peripherally extending edge portion 141 extending at a right angle to the longitudinal axis, In the exemplary embodiment, edge portion 141 is set back from the axial ends of the second part 135, with the distance to the one axial end being less than to the opposite, other axial end.

On the outer edge, the second part 185 of the fixing element is positively supported in the axial direction. The second part 185 can also be referred to as a sealing sleeve. On the face-side end of the second part 135 of the shielding element 159, the first part 181 of the fixing element is positively supported in the axial direction, with the support of the first part 181 lying radially inside compared to the support of the second part 185 of the fixing element. The first part 181 can also be referred to as a spacer sleeve. In the exemplary embodiment, the second part 135 is rotationally symmetrical to its longitudinal axis. By turning up the cable shield 157, it has a defined distance from the main contact.

Between the edge portion 141 of the second part 135 and the housing 148 is the first part 131 of the shielding element 159. In the exemplary embodiment, it has a slotted sleeve which in the undeformed state has a shape that is non-cylindrical, and is especially conical. On or near one axial end, the first part 131 on its outer surface has contact tongues 161 or contact lugs with which electrical contact can be made with the housing 148. The tongues or lugs 161 are preferably uniformly distributed in the peripheral direction and are formed in one piece by embossing. On or near the opposite end, the first part 131 on its inside has second contact tongues 143 or contact lugs with which electrical contact can be made with the second part 135 of the shielding element 159. The second tongues or lugs 143 are arranged preferably uniformly distributed in the peripheral direction and are formed in one piece by embossing.

In the installed state shown in FIG. 14, the first part 131 is formed roughly into a cylindrical shape, since the cable of the line 106 with the parts mounted thereon is pushed into the housing 148 when it is being mounted. Due to the reset force of the first part 131, the first part 131 is in reliable electrical contact, on the one hand, with the inner surface of the housing 148 and, on the other hand, with the second part 135 of the shielding element 159. On the end of the first part 131, a stop is made preferably in one piece for contact with the second part 135, especially for contact with the edge portion 141 of the second part 135 to ensure that the first part 131 is axially in a defined position in the housing 148, especially in a defined position relative to the second part 135 and thus relative to the line 106. The stop can be formed by the second contact tongues 143.

The arrangement of the three contact tongues 161 at a time or three second contact tongues 143 ensures a defined contact of the first part 131 both radially to the outside with the housing 148 and also radially to the inside. For each radially outer contact tongue 161, there is one radially inner second contact tongue 143. The connecting line extending between contact tongues 161, 143 assigned to one another parallel to the longitudinal axis of the line 106 ensure a corresponding current flow direction for the cable shield current. The short distance between the sleeve-shaped first part 131 and the housing 148 ensures good capacitive coupling of the shielding contact.

The outside diameter of the second part 135 in the region of the edge portion 141 is only slightly less than the inside width of the housing 148 minus the thickness of the first part 131. In this region play of less than 2 mm, especially less than 1.2 mm, and preferably less than 0.8 mm is provided. In the exemplary embodiment, the distance is roughly 0.5 mm. When there is a radial movement of the line 106, especially of the cable with the parts attached to it, i.e., also with the second part 135, the first part 131 moves at that axial position at which the first part 131 makes electrical contact with the second part 135, likewise, where the movement experiences a stop when the first part 131 makes contact with the inside of the housing 148.

On its opposite end, the first part 131 conversely does not move in the radial direction, since the first part 131 is centered by the contact of the contact tongues 161 within the housing 148. In this way, the first part 131 is pivoted. This arrangement has the advantage that in this way relative movement takes place at the contact site, as a result of which the contact surfaces are cleaned. The end portion of the first part 131, with which the first part 131 is connected to the second part 135, is bent to the inside relative to the bordering portion by an angle of more than 0.2° and less than 6°, especially more than 0.5° and less than 4°, and preferably more than 0.5° and less than 2.5°, so that this end portion does not experience bending stress during a pivoting motion of the first part 131. This stress would be disadvantageous should vibrations occur. The length of the bent portion is less than 30% of the length of the first part 131, especially less than 20%, and preferably less than 15%. In the exemplary embodiment, the length of the bent portion is equal to the length of the second contact tongues 143+/−25%.

Figure 15:
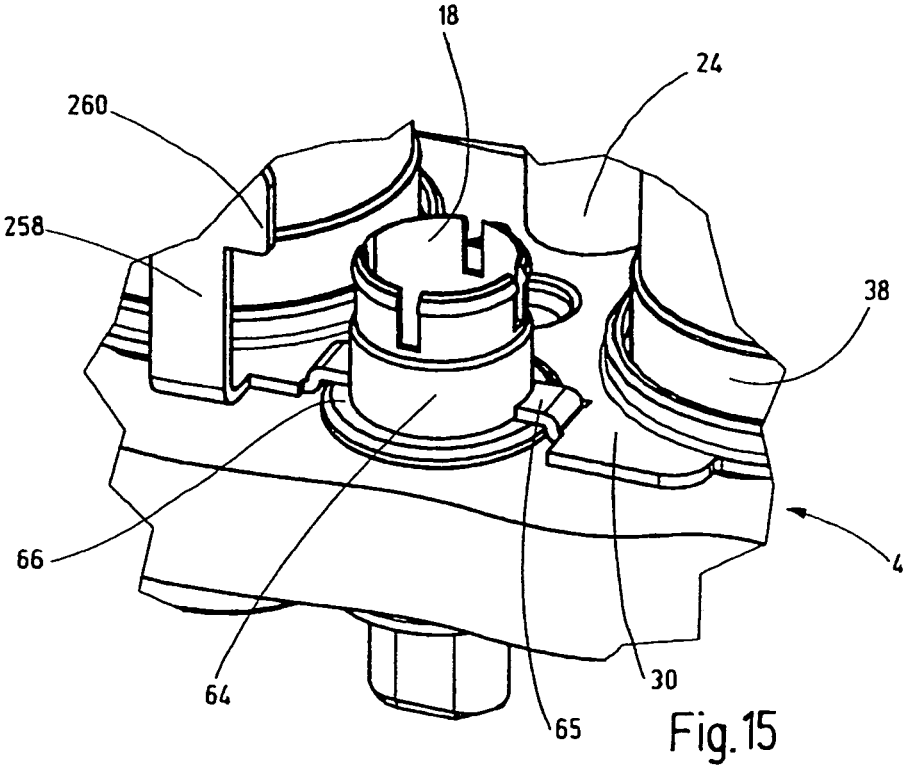
FIG. 15 is a partial perspective view of the second plug-in connector part in the region of the pilot contact of the plug-in connector system of FIG. 3.

FIG. 15 shows a perspective view of an extract of the second plug-in connector part 4 in the region of the pilot contact 18. On its end facing the terminal strip 30, an electrically conductive, loosely attached sleeve-shaped portion 64 on the plug-in unit for the pilot contact 18 has a flange-shaped widening. A contact lug 65, formed preferably in one piece from the terminal strip 30, can be brought into contact-making contact with widening 66. The contact lug 65 can be deflected elastically relative to the terminal strip 30, fixes the sleeve-shaped portion 64 to the housing wall 8, and ensures shield linkage. In one embodiment, the contact lugs 65 are press pads for the conductive sleeve bent down on the end with flange-shaped widening 66 placing the shield linkage at the potential of the generating set.

Figure 16:
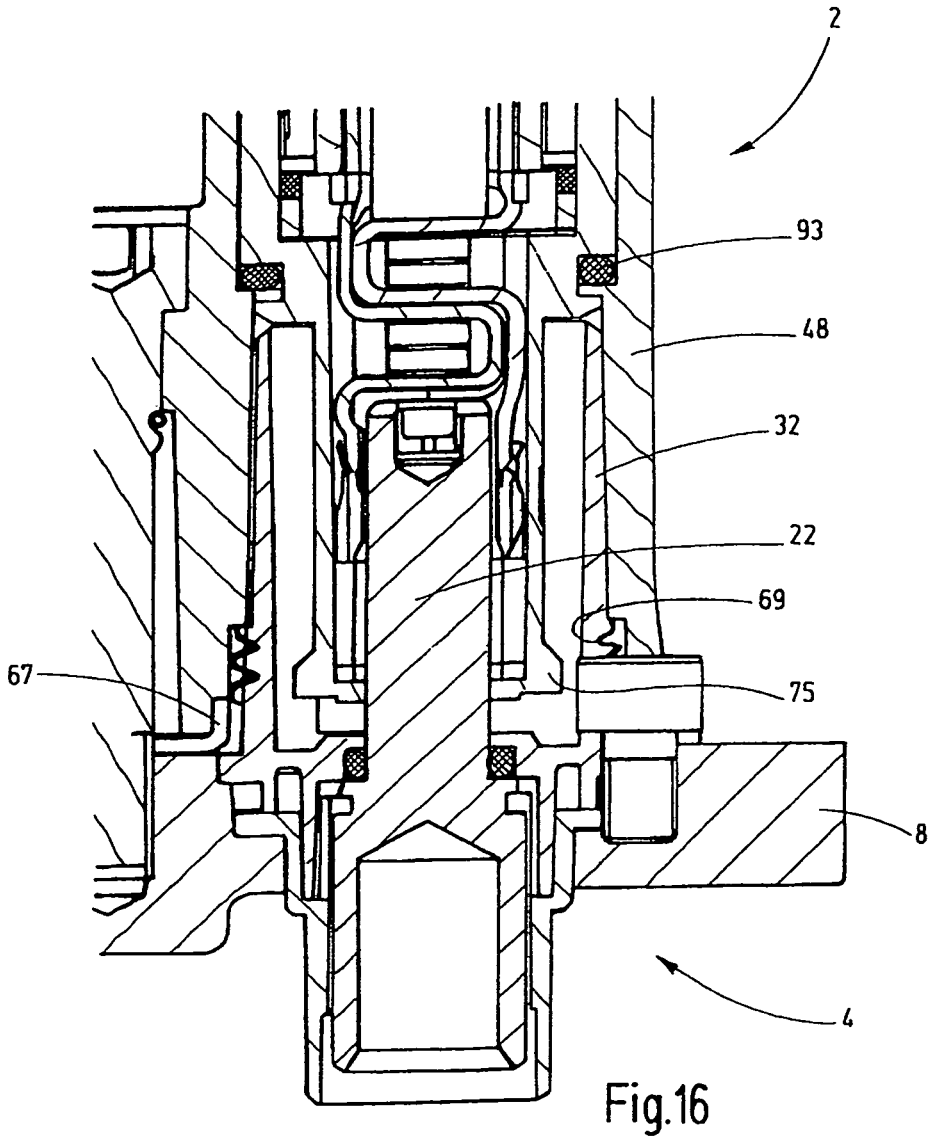
FIG. 16 is a partial side elevational view in section through the housing of the first plug-in connector part.

FIG. 16 shows an extract of a section through the housing 48 of the first plug-in connector part 2 and the housing wall 8 of the generating set with the second plug-in connector part 4 in the mated state. Between the sleeve-shaped portion 32 of the second plug-in connector part 4 and the housing 48 of the first plug-in connector part 2, a seal 69 is provided, especially in contact with the ring-shaped portion 38 (FIG. 1) of the sleeve-shaped portion 32 on the one hand and the housing 48 on the other. The guide portion 75 of the first plug-in connector part 2, in the direction to the second plug-in connector part 4, is beyond the contact elements of the first plug-in connector part 2, so that they are located shockproof in the first plug-in connector part 2. A dome 67, formed preferably in one piece by the terminal strip 30, is in contact-making contact with the housing 48 of the first plug-in connector part 2. In one embodiment, the terminal strip 30 in the region of the passage of the load contacts 12, 14, 16 thus forms a positive counterhold for the housing 48.

FIG. 17 shows a perspective view of a first exemplary embodiment of a plug-in connector element 10 for use in the above-described first plug-in connector part 2. The plug-in connector element 10 has two contact plates 72, 74 formed by shaped, electrically conductive sheet metal strips. Each plate 72, 74 has a connecting portion 76, which in FIG. 17 is hidden by the sleeve-shaped connecting element 78, for electrically connecting the plug-in connector element 10 to the electric line 6. Furthermore, the contact plates 72, 74 have a contact portion 82 for a detachable electrical connection of the plug-in connector element 10 to a contact element of the second plug-in connector part 4. Furthermore, the contact plates 72, 74 have a compensating portion 80 located between the connecting portion 76 and the contact portion 82 for elastically deflecting the contact portion 82 relative to the connecting portion 76.

In the region of the connecting portion 76, the two contact plates 72, 74 are bent into the shape of a partial circle, especially roughly into a semicircle, and are fixed in the illustrated position by the sleeve 78. The connecting element 78, on its end facing the contact portion 82, has a support element 84 formed by a flange-shaped widening. By the support element 84, the connecting element 78 can be supported on an opposite element. As described above, thus the connecting element and the line 6 can then be fixed by positive engagement in the housing 48 of the first plug-in connector element 2 when a tensile force arises. Tensile forces or, for example, vibrations are then not relayed to the contact portion 82, as a result of which the electrical connection is especially reliable.

The line 6 to be connected to and to be inserted in the connecting portion 76 is stably and reliably connected to the plug-in connector element 10 by crimping of the sleeve 78, especially by the molding-on of a hexagon. The support element 84 causes the forces and/or deformations occurring during crimping to be kept away from the compensating portion 80. For this purpose, it is especially advantageous if another first widening portion 73 is placed ahead of the support element 84, so that the connector element 78 has a two-stage or also multistage widening.

In the compensating portion 80, the two contact plates 72, 74 are each bent in a meander shape, where, proceeding from the connecting portion 76, first the first contact plate 72 forms one U-shaped loop and then in the axial direction the second contact plate 74 forms a substantially equally dimensioned U-shaped loop. Then, the two contact plates 72, 74 extend further into the contact portion 82. On the bending sites of the meandering loops, the two contact plates 72, 74 each have at least one recess 86 by which the strip width of the contact plate 72, 74 is reduced and thus the bending stiffness is reduced. In the two parallel legs 88 of the meandering loop, the two contact plates 72, 74 have tool engagement surfaces 90 which in the exemplary embodiment are formed by holes by which the contact plates 72, 74 can be fixed when the loops are bent. Alternatively or in addition, holes can be formed in the contact plates for reducing bending stiffness. Moreover, the contact plates 72, 74 in the region of the legs 88 extending parallel have stops 92 which in the exemplary embodiment are formed by lugs which are bent by 90° and which are formed in one piece by the contact plates 72, 74.

In the contact portion 82, the two contact plates 72, 74 are bent in a V-shape and include an angle of between 60° and 150°, and preferably between 75° and 120°. Alternatively to the V-shape, the contact plates 72, 74 have a bent shape deviating from the cross-sectional contour of the contact element of the second plug-in connector part 4, so that one or preferably two line contacts per contact plate 72, 74 are created. A separate spring 94 is seated on the contact plates 72, 74 bent in this way, and with it the contact plates 72, 74 can be kept in contact-making contact with the contact element of the assigned second plug-in connector part 4. The separate spring 94 has a ring-shaped portion 96 which limits the maximum widening of the contact plates 72, 74 in the contact portion 82. Spring arms 98 project in the axial direction from the ring-shaped portion 96; in the undeformed state they are bent to the inside and apply the contact force. In the exemplary embodiment, there are two spring arms 98 on opposite sides.

Offset by 90° at a time to the spring arms 98, the separate spring 94 has guides 68 bent on or near its free end radially to the inside and engage a gap formed between the two contact plates 72, 74. In this way, the guides 68 guide the separate spring 94 when clipped onto the contact portion 82. At the transition from the contact portion 82 to the compensating portion 80, the two contact plates 72, 74 form a stop 70 for slipping on the separate spring 94 by a radial widening.

FIG. 18 shows a perspective view of a second exemplary embodiment of a plug-in connector element 110 for use in the above-described first plug-in connector part 2. In the contact portion, the first and the second contact plates 172, 174 have lugs 111, 113 projecting to the outside and jointly forming a guide and a stop for clipping on the separate spring 194. The ring-shaped portion 115 of the separate spring 194 is located on one end facing the second plug-in connector part 4. From the ring-shaped portion 115, on opposite sides, guides 117 project and are inserted between the two lugs 111, 113 when the separate spring 194 is clipped on. The guides 117 have a rounded or beveled end portion. The guides 117 alternatively or additionally form spacers preventing the two contact plates 172, 174 from being pressed together to an excessive degree.

Latches 119 project from the ring-shaped portion 115 on opposite sides and interact with corresponding latches 121 of the contact plates 172, 174. In the exemplary embodiment, the latches 119 of the separate spring 194 have openings or depressions that are engaged by the latches 121 formed, for example, in one piece by embossing from the contact plates 172, 174, for example, a nub.

On the end side, the ring-shaped portion 115 ends substantially flush with the contact plates 172, 174. The contact plates 172, 174, on the end side, form an insertion bevel 125 for the contact pin 22 (FIG. 1). Each of the contact plates 172, 174, due to its shape, has two line contacts 123 for the contact-making contact with the contact pin 22.

In the region of the connecting portion, especially on its connecting portion-side end, the connecting element 178 has an adjustment device 127 by which the position of the connecting element can be set with reference to the contact plates 172, 174. The adjustment device 127 can be formed by a recess into which, right after the contact plates 172, 174 are inserted, a corresponding positioning is impressed. The connecting element 178 then is kept only in one definable angular position on the contact plates 172, 174 and is protected against rotation during further mounting.

Figure 19:
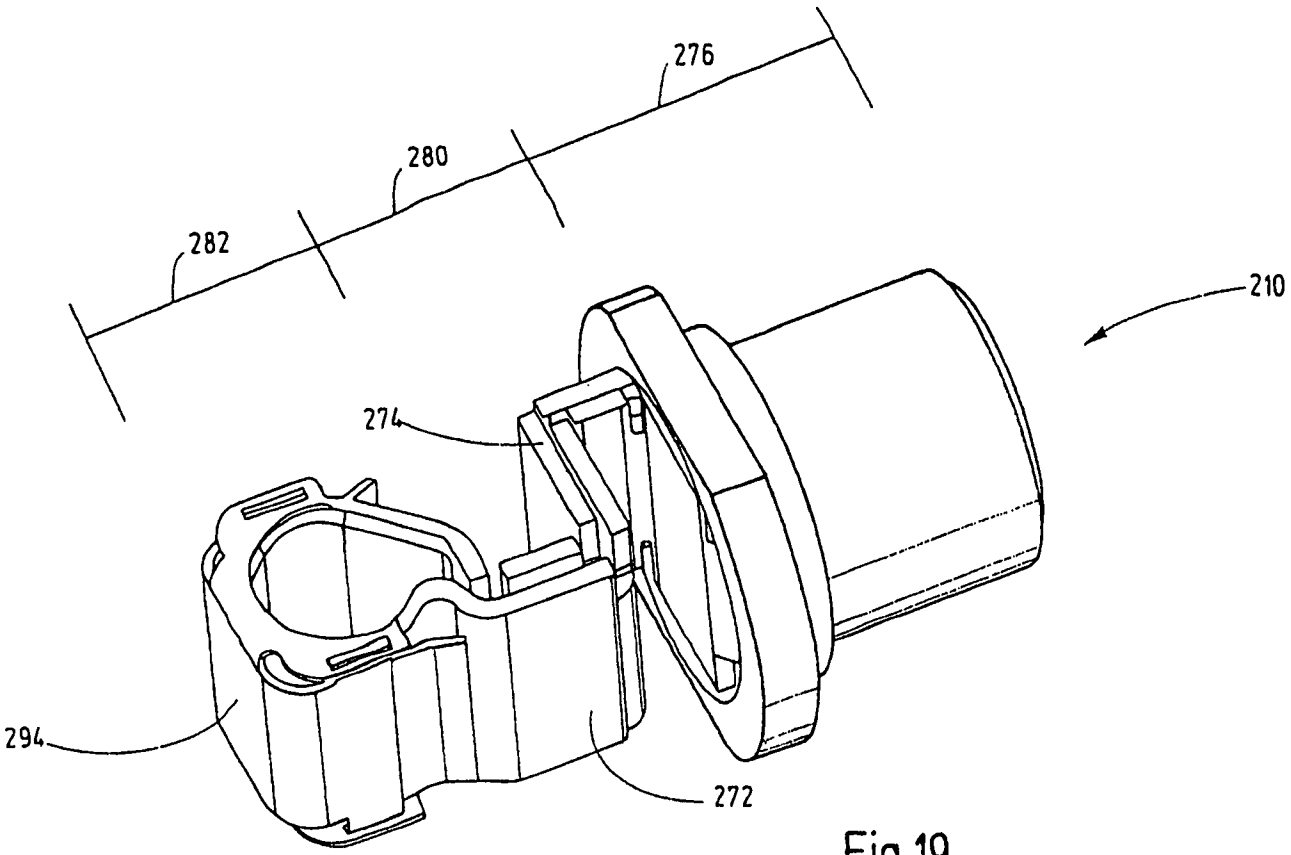
FIG. 19 is a perspective view of an exemplary embodiment of a plug-in connector element for a right angle plug.

FIG. 19 shows one exemplary embodiment of a plug-in connector element 210 for a right angle plug. In contrast to the plug-in connector element 10 of FIG. 17, one of the contact plates 274 is simply bent at a right angle and need not form a complete meander loop. The contact pin 22 (FIG. 1) is inserted transversely to the longitudinal direction of the plug-in connector element 210, defined by the successive arrangement of connecting portion 276, compensating portion 280, and contact portion 282. The separate spring 294 is produced as a punch/bent part and is seated on the contact portion 282.

Figure 20:
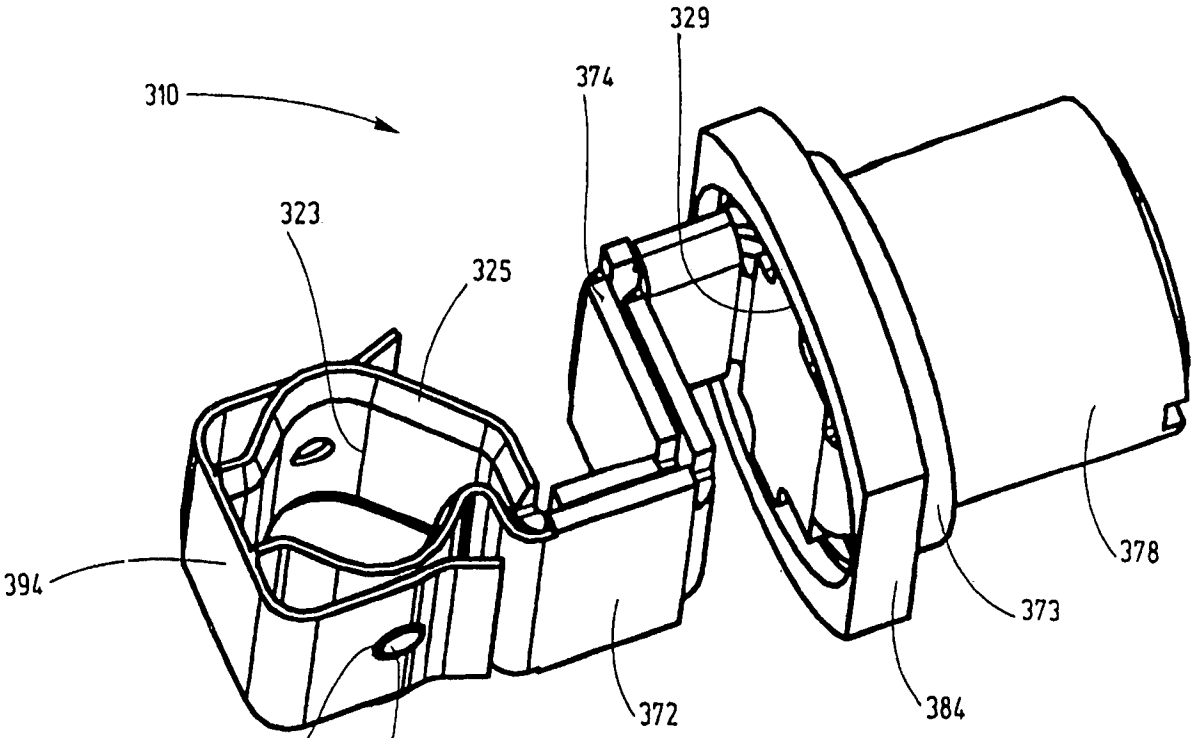
FIG. 20 is a perspective view of another exemplary embodiment of a plug-in connector element for a right angle plug.

FIG. 20 shows another exemplary embodiment of a plug-in connector element 310 for a right angle plug. The separate spring 394 has two legs with at least one latch 319, each interacting with corresponding latches 321 of the contact plates 372, 374. In the exemplary embodiment, the latches 319 of the separate spring 394 each have an opening or depression engaged by the latches 321, which are made, for example, by embossing in one piece from the contact plates 372, 374, by latching.

On the end side, the contact plates 372, 374 form an insertion bevel 325 for the contact pin 22 of the second plug-in connector part 4. Each of the contact plates 372, 374, due to its shape, has two line contacts 323 for the contact-making contact with the contact pin 22.

At least one of the contact plates 372, 374 has a stop 329 made preferably in one piece by which the contact plates 372, 374 can be inserted in the connector element 378 only up to a corresponding stop. The corresponding stop can be formed by the transition from the support element 384 to the first widened portion 373 on the inside of the connecting element 378.

For all illustrated plug-in connector elements, a reliable electrical connection is made available by providing a total of four line electrical contacts. The separate springs 94, 194, 294, 394 ensure a nonpositive contact with the corresponding contact element of the assigned second plug-in connector part 4. The compensating portion 80, 280 ensures reliable contact between the contact portion 82, 282 and all four contact lines. In particular, compensation of a parallel offset or of a tilted position of the contact element with which contact is to be made is ensured. The high current carrying capacity is made available by the direct contact of the contact plates 72, 74 which have a large cross-sectional area with the contact pin 22. The required flexibility of the contact plates 72, 74 is made available by the compensating portion 80, 280 made separately from the contact site and the connection to the line 6.

While various embodiments have been chosen to illustrate the invention, it will be understood by those skilled in the art that various changes and modifications can be made therein without departing from the scope of the invention as defined in the appended claims.

What is claimed is:

1. A device for electrically connecting a cable, comprising:

a housing;

a connecting element mechanically tightly connectable to an inner conductor of the cable;

at least one fixing element immovably fixing said connecting element, along with the inner conductor, in said housing by positive engagement resisting a tensile force thereon, said connecting element, said fixing element and said housing each including at least one contact surface oriented at an angle relative to an axial direction of said tensile force and the cable, respective ones of said contact surfaces contacting one another one of directly and indirectly to provide said positive engagement; and an electrically deformable spring element preloading said connecting element within said housing in said axial direction.

2. A device according to claim 1 wherein said connecting element is sleeve-shaped at least in sections thereof and is mechanically tightly connected to the inner conductor of the cable by clamping.

3. A device according to claim 2 wherein said connecting element is pressed against the inner conductor of the cable.

4. A device according to claim 1 wherein said fixing element comprises first, second and third parts arranged in succession in a direction of said tensile force and being one of in direct contact with one another, respectively, and in indirect contact with one another, respectively, with positive interposition of another element.

5. A device according to claim 4, wherein a connecting lead for a cable shield of the cable extends through two of said parts of said fixing element that are adjacent one another in the direction of said tensile force.

6. A device according to claim 1 wherein said contact surfaces are perpendicular to said axial direction.

7. A device according to claim 1 wherein said spring element contacts an intermediate element, said intermediate element being kept in contact with said connecting element by a reset force of said spring element.

8. A device according to claim 7 wherein said intermediate element is sleeve-shaped at least in sections thereof.

9. A device according to claim 7 wherein said intermediate element forms a shock protection for a contact element in said housing.

10. A device according to claim 9 wherein said intermediate element comprises a sleeve projecting in an axial direction of said contact element.

11. A device for electrically connecting a cable, comprising:

a housing;

a connecting element mechanically tightly connectable to an inner conductor of a cable;

at least one fixing element immovably fixing said connecting element, along with the inner conductor, in said housing by positive engagement resisting a tensile force thereon; and an elastically deformable spring element preloading said connecting element within said housing in a direction of positive contact with said fixing element.

12. A device according to claim 11 wherein said spring element contacts an intermediate element, said intermediate element being kept in contact with said connecting element by a reset force of said spring element.

13. A device according to claim 12 wherein said intermediate element is sleeve-shaped at least in sections thereof.

14. A device according to claim 12 wherein said intermediate element forms a shock protection for a contact element in said housing.

15. A device according to claim 14 wherein said intermediate element comprises a sleeve projecting in an axial direction of said contact element.

* * * * *